US008225882B2

(12) United States Patent
Geci et al.

(10) Patent No.: US 8,225,882 B2
(45) Date of Patent: Jul. 24, 2012

(54) APPARATUS FOR BORING HOLES IN ROCK MASS

(76) Inventors: Jozef Geci, Bratislava (SK); Tobias Lazar, Kosice (SK)

( * ) Notice: Subject to any disclaimer, the term of this patent is extended or adjusted under 35 U.S.C. 154(b) by 0 days.

(21) Appl. No.: 13/027,394

(22) Filed: Feb. 15, 2011

(65) Prior Publication Data

US 2011/0198123 A1 Aug. 18, 2011

Related U.S. Application Data

(63) Continuation-in-part of application No. PCT/SK2009/050006, filed on Aug. 12, 2009.

(51) Int. Cl.
*E21B 7/14* (2006.01)

(52) U.S. Cl. ..... 175/11; 175/17

(58) Field of Classification Search ..... 175/11, 175/16, 17, 64; 299/14
See application file for complete search history.

(56) References Cited

U.S. PATENT DOCUMENTS

| | | | | |
|---|---|---|---|---|
| 2,953,353 | A * | 9/1960 | Allen | 175/16 |
| 3,679,007 | A * | 7/1972 | O'Hare | 175/16 |
| 3,693,731 | A | 9/1972 | Armstrong et al. | |
| 5,107,936 | A * | 4/1992 | Foppe | 175/11 |
| 5,168,940 | A | 12/1992 | Foppe | |
| 5,479,994 | A * | 1/1996 | Soloviev et al. | 175/11 |
| 5,735,355 | A * | 4/1998 | Bussod et al. | 175/11 |
| 6,455,808 | B1 * | 9/2002 | Chung et al. | 219/130.51 |
| 6,591,920 | B1 * | 7/2003 | Foppe | 175/67 |
| 6,870,128 | B2 * | 3/2005 | Kobayashi et al. | 219/121.7 |
| 7,270,195 | B2 * | 9/2007 | MacGregor et al. | 175/16 |

FOREIGN PATENT DOCUMENTS

| | | |
|---|---|---|
| DE | 2554101 C2 | 6/1977 |
| DE | 200810031490 | 1/2010 |
| SK | 278692 | 11/1994 |
| SK | 278849 | 11/1994 |
| SK | 278850 | 11/1994 |
| SK | 278650 | 12/1997 |

OTHER PUBLICATIONS

Paul Busse "The Future Is Below Us—Building and Living Underground", Bauen und Leben unter der Erde, Ausstellung Congress Centrum Hamburg (1997).

"Lithofracturing and Rock Mechanics", Inf. Report on Subterrene Technology. LANL, Los Alamos (1970).

International Search Report dated Nov. 13, 2009, issued in corresponding International Application No. PCT/SK2009/050006.

* cited by examiner

*Primary Examiner* — Daniel P Stephenson
(74) *Attorney, Agent, or Firm* — Ostrolenk Faber LLP

(57) ABSTRACT

A device for boring holes in rock mass working in a system, in which the reference axis is the axis of gravity, with thermal, pressure and sound energy comprises an assembly of at least one cone-shaped disintegrator body having an inner feed space. The front of the body houses nozzles followed by pressure sensors and has drainage flow lines distributed at its sides and leading into the surrounding space. The assembly further includes a cooperating hollow geometrical penetrator body. A forced movement of at least one disintegrator body occurs within the inner space of the penetrator body. The penetrator body has a broader front part, the cavity of which houses combustion chambers as well as signal and power media feed controlling components and has relaxation flow lines distributed at its sides. The middle part houses technical assemblies separating the working space at the front from the feed space.

4 Claims, 1 Drawing Sheet

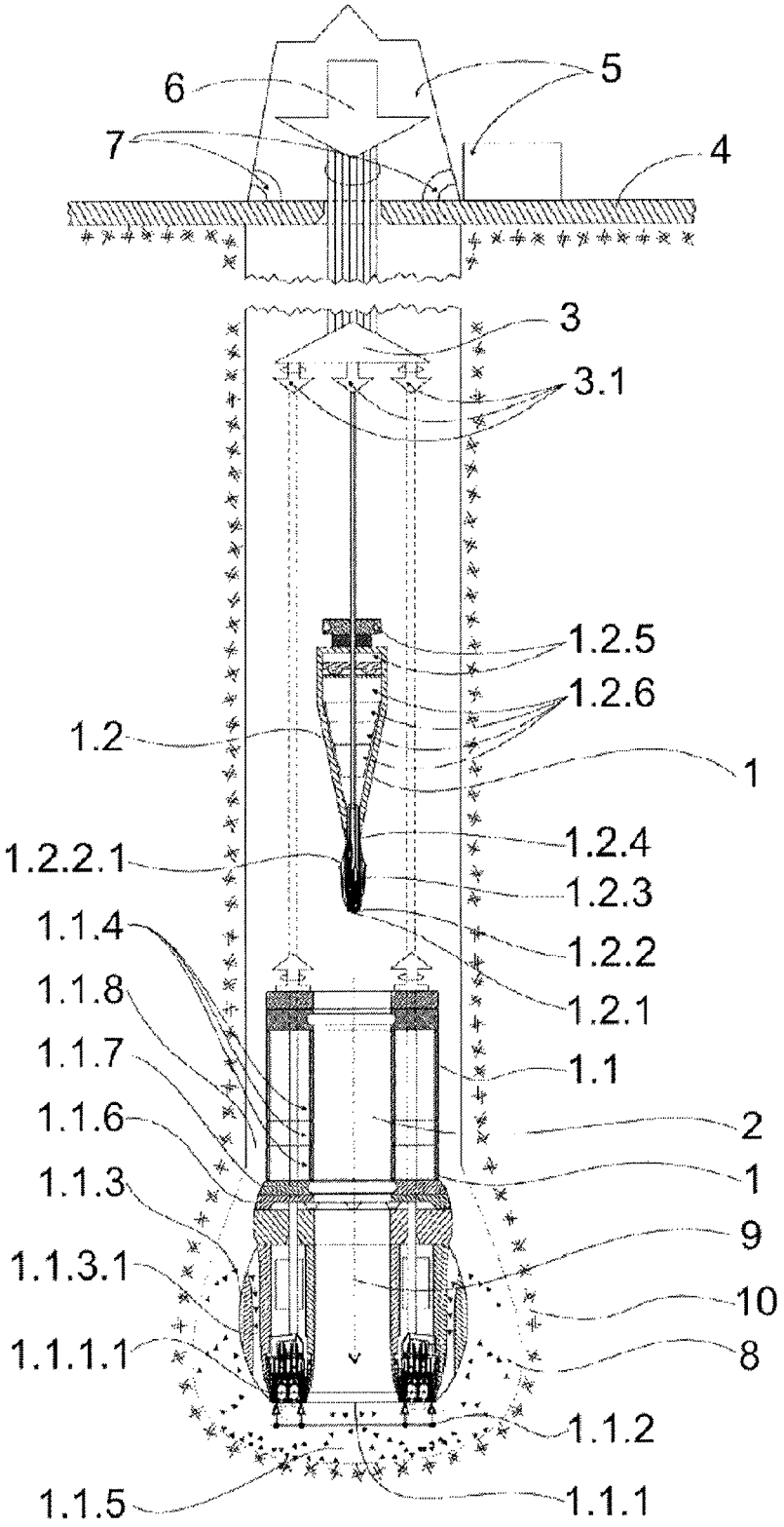
6
5
7
4
3
3.1
1.2.5
1.2.6
1.2
1
1.2.4
1.2.2.1
1.2.3
1.1.4
1.2.2
1.1.8
1.2.1
1.1.7
1.1
1.1.6
2
1.1.3
1
9
1.1.3.1
10
1.1.1.1
8
1.1.2
1.1.5
1.1.1

APPARATUS FOR BORING HOLES IN ROCK MASS

This application is a continuation-in-part application based on PCT Patent Application No. PCT/SK2009/050006, filed Aug. 12, 2009, which claims benefit of Slovakian Patent Application No. PP 5075-2008, filed Aug. 15, 2008. The contents of both the PCT application and the Slovakian application are incorporated herein by reference.

TECHNICAL FIELD

The present invention relates to an apparatus for boring holes in rock mass working in a system in which the reference axis is the axis of gravity.

BACKGROUND ART

The great majority of technologies for boring holes in thick-walled objects, and particularly in the earth's mass, are based on the principle of mechanical disaggregation of the object's rock matter with the domination of methods such as boring, braking, blasting, etc. Most of the experiments with other disaggregation methods used deeper in the Earth, especially in rock formations, proved unusable due to a low cost efficiency and ineffective tool transfer of energy released to the earth's bedrock. An overview of the state of the art technologies with an outlook for the future is provided by the publication "Die Zukunft liegt unter uns. Bauen and Leben unter der Erde. Ausstellung Congress Centrum Hamburg 15.9.97 bis 2.11.97," suggesting possible solutions to the problem, while for the most part accepting present trends. An exception is a full face horizontal tunnel boring machine, where the energy transfer concept of the presented vision comprises an unacceptable principle. Full face boring by flame in the axis of gravity is described in the following patent publications: DE 2554101 C2, and also in the patents SK No. 278849, 278692, 278850. Remarkable references to thermal energy boring can be found in articles LITHOFRACTURING AND ROCK MECHANICS. Inf. Report on Subterrene Technology. LANL, Los Alamos, 1970.

Part of the state of the art is patent SK 278 650 presenting an apparatus for full-face boring of holes in the ground, the said apparatus being classified, based on its functionality, as a heat and pressure tool with disintegration effect on the boring object's fundament.

There is known from the state of the art a device according to U.S. Pat. No. 3,693,731 working on the principle of transmitting mechanical-thermal cleaving forces into the rock. The source of these destructive forces is the weight of the device and co-acting additive external pressing forces transferred, together with thermal energy, through a wall of the active part of the device. The source of thermal energy is the Joule principle of converting electric current to heat in an ohmic body located at an active part of the device, which should be in direct contact with the rock.

U.S. Pat. No. 5,168,940 represents another solution intended to remove sinking products (molten and unmolten rocks). Said patent describes combustion of a gaseous mixture exhaling from a circuit of an active face of a hollow annular cylindrical part where the gaseous mixture of oxygen and hydrogen is combusted with subsequent production of water vapour, being in direct contact with the rock whose molten volume is proportional to the face surface area and to the shift of the boring device. The patent does not solve issues associated with interaction of the tooling part and the rock.

The control of the technological melting is absent. Interactive feedbacks of reactivity of rock's properties, varying in terms of process, are not accepted.

Published patent application DE 200810031490 uses the same conversion method of thermal energy and its effect upon rock as disclosed in the above mentioned patent U.S. Pat. No. 5,168,940.

The state of the art does not disclose a combination of using in principle different boring tools working according to different physical methods of energy transfer into rocks. The reason is due to unknown interaction conditions caused e.g. by mechanical cleaving whose effects are impaired by presence of the heat. Even if it was theoretically possible to admit the existence of a combination of U.S. Pat. No. 3,693,731 and U.S. Pat. No. 5,168,940, it would require the presence of external pressing forces. Their transfer into great depths would require mechanical connection using rods characterized by a distortion while stressed due to axial lateral flexure. This circumstance excludes their usage for boring pursuant to axis of centre of gravity.

In the aforementioned patents the issue is not dealt with comprehensively, a secondary thermal energy transfer is used, ecological requirements are not respected, boring processes are not controlled, effects of cross synergic bonds are not utilised, and the latest technologies in material engineering, cybernetics and application of nanotechnologies are not used. The above patent documents and published articles do not address basic issues associated with melt production, its utilisation for lining the walls of bored holes with a vitrified material and the anchoring of such material to cracks of the surrounding rock. In the patent documents and reference literature their respective authors do not address the issue of boring in desired coordinates. The purpose of this invention is to change this undesirable situation and to avoid the aforementioned deficiencies.

DISCLOSURE OF INVENTION

Deficiencies specified in the state of the art are largely eliminated by the solution according to the present invention.

It has been discovered that a solution to this task is an apparatus for boring holes in rock mass utilising thermal, pressure and acoustic energy produced by the apparatus's own tool parts, the characteristic feature of the apparatus being that it is an assembly comprising at least one disintegrator body and a penetrator body that is coaxial to and working in concert with the disintegrator. The penetrator is a geometrical body of a variable shape (cylinder, oval) in the cavity of which the disintegrator body (disintegrator bodies) is (are) in motion according to a boring controlling algorithm. The penetrator body has a broader front part. A cavity of this front part houses combustion chambers, as well as signal and power media inlet controlling components. This broader front part also features relaxation flow lines distributed at its sides. The centre of the penetrator cavity houses technical assemblies including an acoustic membrane and an anti-sonic shield, isolating the working space at front from the feed space. The disintegrator body is preferably of cone geometry with nozzles of the disintegrator body located at its front. There are pressure sensors located behind the disintegrator body's nozzles and drainage flow lines distributed at sides and leading into the surrounding space. The disintegrator body is fitted with a handling closure and adapted for connecting to controlled tractional forces of the logistic system. The number of disintegrator bodies used is dictated by the size of the cross-section area of the bored space.

The movement of the disintegrator body within the interior of the penetrator body is defined in terms of space by their shape and size differences, and in terms of function by the pressure and thermal power differences and by the time-differentiated disintegrator and penetrator operation modes.

The disintegrator body and the penetrator body are equipped with a penetrator combustion chamber starting system, disintegrator starting and control system and also with a feed space filled with a power medium that is supplied by a logistic network always in quantity sufficient for conducting one work cycle.

Power media used include—but are not limited to hydrogen, kerosene, petroleum, gases, gels, etc.

There exist several controlling methods of the boring process known for example from solutions cited in the related art. Therefore, particulars of the controlling method are not the subject matter of the present invention.

Signal media used include—but are not limited to electric power, light flux, etc.

When boring holes in rock mass the apparatus is activated in such a way that the disintegrator body starts acting first, disrupting the mass of the fundament. The change in the structure of the fundament's mass in the case of procedural drilling comprises the following phases:

controlled inflow of oxygenated fuel and its ignition at the discharge point from the disintegrator's nozzles, disposed on the face of the disintegrator, results in flame which heats up the rock, while the heat generates particles—rippings which gradually melt. Combustion is accompanied by sound, the energy of which contains a transverse as well as longitudinal component, where especially the transverse component facilitates rock disintegration. The escape of unmelted particles and the molten rock creates room that changes the pressure and sound conditions in the disintegrator's nozzles. Through the movement of the disintegrator this change of pressure and sound energy of the flame outlet from the disintegrator's nozzles will cease to have effect and the system will return to the initial state. The advance (translation) is brought about by the dead weight of the disintegrator. The next process is determined by Archimedes' principle, under which a state of equilibrium is reached when the weight of the molten rock with rippings is equal to the weight of the disintegrator. Further combustion of the flame increases the temperature, pressure and conditions for sound propagation, which results in further molten rock, which runs by turbulent flow through compensating ports, located on the sides of the disintegrator's taper, to the taper head, where through its potential energy it increases the compressive force (weight) of the disintegrator. This process continues until the solidification of the created molten rock over the front portion of the penetrator. In a given time period (dynamic effect), the density (compression) under the taper's head and in the volume not filled with molten rock begins to grow. The density regulator opens an additional inflow of fuel (positive feedback), which raises the temperature, especially through the pressure in the combustion area. In reaching a density exceeding that of the rock, and under the action of pressure, the rock disintegrates and moves to above the disintegrator. The disintegrated rock absorbs the rest of the molten rock (its quantity is controllable), which will flood up the gaps of the unmelted particles. After cooling this mass, together with the disintegrator, form a single whole. This whole is extracted with the aid of an auxiliary hoisting device (winch). The particulars of the hoisting device is not a subject matter of this disclosure.

It has been proven (see part "Prior State of the Art", article Litho Fracturing and others) that the described disintegration is accompanied by cracks that extend up to a distance of 600 times the borehole diameter. From the above it follows that the rock surroundings around the disintegrator are disturbed and ready for the use of a penetrator, the mechanism of the physical processes of which is similar. In the front portion of the penetrator body combustion chambers are used, ending in nozzles of the penetrator from which (similarly as in the case of rockets) flame emerges. A change in pressure conditions of the combustion generates sound energy that is of a higher value than that of the disintegrator body, thus significantly reducing the need for thermal and pressure energy to melt and fissure the rocks. Likewise also the quantity of the molten rock extracted through the relaxation flow lines along the outer circumference of the penetrator body, is considerably greater and after solidification the gain is considerably more massive. In the internal annulus of the penetrator body the remainder of the molten rock is absorbed by the parts that are the product of the disintegrator's work.

There may be any number of disintegrators. A guide for the chosen number is the chosen diameter of the borehole and the technology for extracting the disintegrators begirded in the solidified mass of the molten rock and rippings, or fragments.

Based on the step change of the resistance of the fundament the corresponding signal medium determines the start of the penetrator body engagement. The penetrator body gradually melts disrupted parts of the fundament and of its surroundings. Produced hot melt gradually fills the volume of the bored space. The combustion chambers, continuously supplying thermal and pressure energy, cause the mass of burnt fuel and steam trapped in the space together with the hot melt produced by the said energies to accumulate inside the broader front part. Growing pressure energy pushes the melt into cracks emerging in the fundament as a result of this part of the boring operation, and the rest of the hot melt pervades in the direction of the gravity axis through the flow lines, in which is developed a pressure force determining the speed of the boring process. With the consequent overall quantity of mass growing the melt transfer rate declines and the resistance of the environment rises. When the melt transfer comes to a complete halt the disintegrator body is activated, the starting of which, after the melt has been removed from its collection chamber, marks the end of the first working stage of the combined apparatus and beginning of the next. These stages cycle until the desired state is achieved. For the apparatus to continue functioning, the solidified melt stuck to the body of the disintegrator as a result of the disintegration operation must be repeatedly removed.

An integral part of the apparatus ensuring functioning thereof is a central system with a logistic assembly comprising a logistic network. By means of programmed steps the central control system controls fuel and energy flows that also activate the apparatus's protection components. The central control system can be designed alternatively to respond to specific requirements.

As can be clearly seen from the above, the disintegrator body and the penetrator body forming an assembly described above and in the below embodiment example, which bodies, if connected to a suitable control system and a suitable logistic assembly feeding them with energies, are able to perform the boring process in desired coordinates even alone as independent units. However, their synergic collaboration, alternation of two different technologies in the mode outlined above and further detailed in the example below, where one technological process prepares a workspace for application of the other technological process, a higher technological and economical efficiency is achieved, as manifested by the savings of energy required for the boring process, the speed with which the desired outcome is achieved, and last but not least by the fact that the structure of the bored out space is stabilised due to the solidified melt filling the cracks and reinforcing the walls, thus eliminating the need for casing.

BRIEF DESCRIPTION OF THE DRAWINGS

FIG. 1 of the attached drawing is a schematic cross-section of the apparatus according to the invention described in Example 1.

BEST MODE FOR CARRYING OUT THE INVENTION

Example 1

The apparatus 1 according to the present invention designed for boring holes in the direction of its gravity axis for the repository of spent nuclear fuel used for electric power generation in nuclear power plants constitutes an assembly comprising a disintegrator body 1.2 and a penetrator body 1.1 working in concert with each other. This whole assembly forms the tool part for the operation of boring a hole 8 in ground 10. Before the boring process can start the apparatus must be connected to the logistic assembly 5 that ensures the functioning of the apparatus 1 by means of a logistic network 6. The logistic network 6 supplies the apparatus 1 with power media, which in this case are kerosene and its oxidizing agent, and cooling media—water, electric power, which are fed by means of a central control system 3 to the apparatus 1 where control systems 1.1.2 and 1.2.2 activate combustion chambers 1.1.1.1 in the penetrator body 1.1 and disintegrator's nozzles 1.2.1 in the disintegrator 1.2. Program steps of the central control system 3 determine the fuel and electric power flows via a corridor 3.1 and activate an isolation shield 4, a safety closure 7 and drive the disintegrator body 1.2 to the cavity 2 in the direction of the gravity axis 9 so as to bring it closer to the ground fundament 10. The energy of burning kerosene is outlet from the disintegrator's nozzles 1.2.1 and its thermal, pressure and acoustic energy erodes the integrity of walls surrounding the bored hole 8. The next program step activates the penetrator body 1.1 the front part 1.1.1 of which cumulates the energy of combustion chambers 1.1.1.1 to a resulting energy flow. Acoustic energy that destructively acts on the ground fundament 10 in the space 8 is part of pressure and thermal energy. Acoustic energy is produced by combustion process that does not proceed in co-phase with pressure and it has two components—longitudinal and transverse. Both of these components produce a destructive complex field. Acoustic energy causes the acoustic membrane 1.1.6 to oscillate, causing oscillation of the broader front part 1.1.3. Oscillation prevents sticking of solidifying melt to walls. Anti-sonic shielding 1.1.7 prevents pervasion of acoustic energy into the feed space 1.1.4 of the penetrator body 1.1. This results in melting of the fundament 10 in the area of the bored hole 8, while the molten material in liquid form floods the area of eroded integrity around the outer and inner perimeter of the apparatus 1. Simultaneously, in the broader front part 1.1.3 of the penetrator body 1.1 in the relaxation flow lines 1.1.3.1 turbulent flow is transformed to potential energy inducing melt reverse flow and force co-acting with the apparatus weight in the direction of the gravity axis 9. Acting pressure presses the resulting molten material into cracks in the walls of the fundament 10 and into the cavity 2 where it solidifies in the collection part 1.2.4 of the disintegrator 1.2. The solidified core is removed by means of a handling closure 1.2.5 through controlled tensile forces of the logistic assembly 5, and conditions for emptying the cavity 2 are created. In this program step the penetrator body 1.1 is put into a stand-by mode by the central control system 3 and it waits for the return of the disintegrator body 1.2 which needs to have the solidified melt removed from it. The next program step is defined by the logistic network 6 that replenishes the feed space 1.2.6 for the disintegrator body 1.2 and the feed space 1.1.4 for the penetrator body 1.1. The logistic network then prepares the apparatus 1 for the work cycle to be repeated.

The invention claimed is:

1. An apparatus for boring holes in rock mass working in a system in which the reference axis is the axis of gravity, utilising thermal, pressure and acoustic energy, wherein the apparatus is an assembly comprising at least one disintegrator body of a cone shape geometry having an inner feed space for energies, a front of which houses nozzles of the disintegrator body with pressure sensors, and a broader part of which, transforming into a collection space, is fitted with drainage flow lines distributed at its sides and leading into a space around the disintegrator body and also a cooperative penetrator body which is a hollow geometrical body, the cavity of which determines a space for a movement of at least one disintegrator body, wherein the penetrator body comprises a broader front part housing combustion chambers with nozzles of the penetrator body and signal and power media feed controlling components and having relaxation flow lines distributed at its sides, and the middle part of the penetrator body housing technical assemblies separating its broader front part from a feed space.

2. The apparatus according to the claim 1, wherein the number of disintegrator bodies included in the assembly is determined by the size of a cross-section area of a bored space.

3. The apparatus as claimed in claim 1, wherein the apparatus further comprises a programmable central control system for controlling fuel and electric power flows via a corridor of their transfer, a starting system for the combustion chambers of the penetrator body, a starting and control system of the disintegrator body, an isolation shield and a safety closure and a logistic assembly with a logistic network.

4. The apparatus as claimed in claim 1, wherein the technical assemblies include an acoustic membrane and an anti-sonic shield and the disintegrator body is equipped with a handling closure and adapted for connecting to controlled tractional forces of the logistic assembly.

* * * * *

UNITED STATES PATENT AND TRADEMARK OFFICE

CERTIFICATE OF CORRECTION

PATENT NO. : 8,225,882 B2
APPLICATION NO. : 13/027394
DATED : July 24, 2012
INVENTOR(S) : Jozef Geci and Tobias Lazar It is certified that error appears in the above-identified patent and that said Letters Patent is hereby corrected as shown below:

Title Page, below Item (22) insert

--(30) Foreign Application Priority Data

August 15, 2008 [SK] Slovakia PP 5075-2008--

Signed and Sealed this
Twenty-fifth Day of September, 2012

David J. Kappos

David J. Kappos
*Director of the United States Patent and Trademark Office*